US006952858B2

(12) United States Patent
Merck

(10) Patent No.: US 6,952,858 B2
(45) Date of Patent: Oct. 11, 2005

(54) WATER EXTRACTION DEVICE

(76) Inventor: Christopher T. Merck, 2649 Hardy Crescent, North Vancouver (CA), V7H 1K3

( * ) Notice: Subject to any disclaimer, the term of this patent is extended or adjusted under 35 U.S.C. 154(b) by 307 days.

(21) Appl. No.: 10/243,759

(22) Filed: Sep. 16, 2002

(65) Prior Publication Data

US 2003/0056317 A1 Mar. 27, 2003

Related U.S. Application Data

(60) Provisional application No. 60/324,935, filed on Sep. 27, 2001.

(51) Int. Cl.[7] ..... A47L 11/30
(52) U.S. Cl. ..... 15/415.1; 15/383; 15/321
(58) Field of Search ..... 15/320–322, 383, 15/401, 415.1

(56) References Cited

U.S. PATENT DOCUMENTS

| | | | | |
|---|---|---|---|---|
| 1,240,799 | A | | 9/1917 | Gray |
| 1,268,962 | A | | 6/1918 | Gray |
| 1,283,499 | A | | 11/1918 | Gray |
| 1,527,828 | A | | 2/1925 | Barr |
| 1,607,774 | A | | 10/1926 | Scheffer |
| 3,683,447 | A | | 8/1972 | Stevenson |
| 3,696,458 | A | | 10/1972 | Leifheit et al. |
| 3,736,619 | A | | 6/1973 | Zamboni |
| 3,793,664 | A | | 2/1974 | Leifheit et al. |
| 3,936,199 | A | | 2/1976 | Zimmermann |
| 3,992,747 | A | | 11/1976 | Hufton |
| 4,000,536 | A | | 1/1977 | Nayfa et al. |
| 4,069,540 | A | | 1/1978 | Zamboni |
| 4,145,823 | A | | 3/1979 | Lucas |
| 4,159,555 | A | | 7/1979 | Schneider |
| 4,210,978 | A | | 7/1980 | Johnson et al. |
| 4,386,873 | A | | 6/1983 | Messner et al. |
| 4,441,229 | A | | 4/1984 | Monson |
| 4,457,042 | A | * | 7/1984 | Jones et al. ..... 15/322 |
| 4,577,364 | A | | 3/1986 | Demetriades |
| 4,595,420 | A | | 6/1986 | Williams, III et al. |
| 4,875,246 | A | | 10/1989 | MacGregor |
| 5,067,199 | A | | 11/1991 | Alazet |
| 5,357,650 | A | | 10/1994 | Finley |
| 5,398,373 | A | | 3/1995 | Blase et al. |
| 5,483,726 | A | | 1/1996 | Blase et al. |
| 5,485,652 | A | | 1/1996 | Holland |
| 5,669,098 | A | * | 9/1997 | Tono ..... 15/321 |
| 5,779,744 | A | | 7/1998 | Mueller et al. |
| 5,893,216 | A | | 4/1999 | Smith et al. |
| 5,930,864 | A | * | 8/1999 | Inoue et al. ..... 15/346 |
| 6,152,151 | A | | 11/2000 | Bolden et al. |
| 6,355,112 | B1 | | 3/2002 | Bartholmey et al. |
| 2002/0104185 | A1 | * | 8/2002 | Weber et al. ..... 15/383 |

FOREIGN PATENT DOCUMENTS

| | | | |
|---|---|---|---|
| JP | 10-14830 | * | 1/1998 |
| JP | 2002-10956 | * | 1/2002 |
| WO | WO 90/14787 | * | 12/1990 |

* cited by examiner

*Primary Examiner*—Terrence R. Till
(74) *Attorney, Agent, or Firm*—Oyen Wiggs Green + Mutala LLP

(57) ABSTRACT

A water extraction device aids in extracting water or other liquids from a floor covering such as a carpet and an associated pad. A housing has a generally cylindrical cavity defined within its interior, and a rotor assembly housed in the cavity. The bottom of the housing has a downwardly facing opening defined therethrough which extends laterally across the bottom of the device, and the rotor assembly protrudes through the opening to provide a means for easy movement of the device by an operator. The housing has a passageway defined through one portion thereof to provide a fluid connection between the cavity within the housing and a vacuum source which is externally applied to the device. The rotor assembly is preferably assembled from a plurality of spoked wheels mounted on a rotor shaft fashioned to be held in eccentric bearings mounted in the aides of the device.

25 Claims, 10 Drawing Sheets

WATER EXTRACTION DEVICE

REFERENCE TO RELATED APPLICATION

This application claims the benefit of U.S. Provisional Patent Application Ser. No. 60/324,935 filed 27 Sep. 2001.

TECHNICAL FIELD

The present invention relates to tools for extracting water from materials, and in particular to devices for extracting water from floor coverings such as flooded carpets and carpet underlay.

BACKGROUND

The present invention is proposed to be used primarily as a assistive tool for drying carpets which have been flooded, and in particular is proposed to be used to extract water from all types of carpet, and from any accompanying carpet pad or underlay. In addition, the device may also be used on hard, smooth surfaces such as linoleum or concrete.

Floods result from burst water mains, malfunctioning sprinkler systems, broken plumbing, backed up drains, and major disasters, such as overflowing rivers and other natural disasters such as hurricanes.

After a flood, the job of cleaning up is sizable. Water, dirt and debris accumulate in carpets and are often retained by the carpet and the accompanying pad. It is common procedure to completely remove the carpet and pad, or other flooring surface, and then allow the flooded surface to dry out. Once thoroughly dry, the damaged floor is replaced, or even resurfaced with new materials.

Water damage accounts for hundreds of millions of dollars in damage each year. The cost of insurance claims is high in part because restoration charges can be high, requiring labour intensive cleaning methods, inexperienced personal and rental costs for drying equipment. The insurance industry has long sought a practical method of restoration in an attempt to "renew"existing materials in attempt to avoid replacement costs.

Standing water in carpets is also a breeding ground for bacteria, mould and mildew, especially in a disaster zone (i.e. after a major flood), and therefore must be dealt with as efficiently and quickly as possible in order to avoid or at least reduce the risk to human health.

It is not always necessary to remove the carpet and pad, or other floor covering after a flood. Rather, it can be cleaned in place, and in many cases the existing materials can be saved. One relatively new system for cleaning such carpets has come to be known as "top down drying", wherein the majority of the water in a wet carpet is removed or "extracted" and then the carpet and pad are "dried" with the use of de-humidifiers, and large volume air movers. Often a "mildewcide" is then used in conjunction with conventional carpet cleaning techniques to restore the carpet and pad.

There have been a number of proposed methods and systems for extracting water from floor coverings, and some produce reasonable results, but many require excessive time and effort. Examples of devices and methods suggested in the past will be found in the art as set forth in U.S. Pat. No. 4,441,229; U.S. Pat. No. 5,357,650; U.S. Pat. No. 6,152,151; and U.S. Pat. No. 6,355,122. Some of the prior art methods and systems may leave behind undesirable residue, such as lubricants, and in some cases actually harm the backing of the carpet because of stresses exerted during extraction. many such prior art devices also compress the carpet and underpad to "squeeze" water out of them. This tends to ruin the carpet.

Further, in many flood situations, water has found its way into the electrical system of the structure, or electricity is unavailable altogether. This makes some of the current methods of extraction unavailable, save for the use of long extension cords or generators.

The removal of water from a carpet and pad or other types of floor coverings thus clearly remains an important concern, and it is still desirable that a system be proposed which provides exceptional extraction results. Preferably, a device should be provided which can be easily operated by one operator, used reliably without a direct electrical source, and which extracts a large amount of water from a wet carpet in a minimum number of passes, thus saving time and money.

SUMMARY OF INVENTION

The present invention provides a device for extracting liquid from a surface, such as water from a wet carpet. The device does not require a direct electrical source but rather uses a large area seal to isolate and focus the vacuum supplied through the device to a specific location directly beneath the tool, requiring little or no amount of compression of the carpet or pad to achieve the desired result.

In a preferred embodiment, the invention provides a device for extracting a liquid from a surface, the device comprising generally a housing having a front portion, a rear portion, a top portion, a bottom portion and first and second side portions. A generally cylindrical cavity is defined within the interior of the housing, and the lower portion of the cavity defines a downwardly facing opening in the bottom portion, the opening extending laterally across the bottom portion from the first side portion to the second side portion. A passageway is defined in at least one of the side portions between the cavity and the exterior of the housing, the passageway thereby allowing a fluid connection between the cavity and a vacuum source external to the device. An elbow may be rotatably affixed to the side portion through which the passageway extends for permitting attachment of the device to a conduit attached to the vacuum source.

A rotor assembly is contained within the cavity and extends along the length thereof, with a portion of the rotor assembly protruding downwardly through the opening. The rotor assembly is rotatable about its longitudinal axis relative the cavity, and preferably, the longitudinal axis of the rotor is parallel to the bottom portion.

The bottom portion of the device comprises a flat bottom surface surrounding the opening. The bottom portion is made up of the lower portions of the side portions and forward and rearward bottom surface base members, the lower portions of each one of the base members having a downwardly-facing flat surface, and the upper portions of each one of the base members having an upwardly facing curved face, the respective curved faces defining the lower portions of the cylindrical cavity in the housing. The lower portions of the side portions and the base members may be constructed of a smooth, low-friction material. Preferably, to create a good seal for suctioning the liquid from the carpet, the ratio of the area of the bottom surface to the area of the opening is at least 1:1.

The rotor assembly comprises a plurality of axially-spaced wheels removably mounted on a shaft rotatable in bearings mounted in the side portions. Each one of the wheels comprises a hub, a rim, and a plurality of spokes extending between the hub and the rim, the spokes defining fluid passages through the wheel from one side thereof to the other. Each wheel is axially-spaced from an adjacent wheel on the shaft such that the rims of the adjacent wheels are spaced from one another. the spacing between the rims is adjustable by altering the spacings between the wheels on the shaft. The rims of the wheels may have ridges, or may be "crooked", or not exactly straight. In a preferred embodiment, the side portions of the housing are removable therefom to allow a user access to the cavity and to the rotor contained within it.

In one embodiment of the invention, the bearings supporting the rotor assembly are eccentric, thereby allowing adjustment of the vertical height of the axis of rotation of the rotor assembly and the vertical distance the rotor assembly protrudes from the opening.

In a preferred embodiment, the rear portion further comprises first and second protrusions protruding rearwardly from the front portion, with a rear wheel attached to each one of the rear protrusions. To allow the device to be used near a wall, the rear wheels preferably do not extend laterally beyond the outer edges of the side portions of the housing.

A compartment may also be formed in the top portion of the housing for accepting ballast added to the device to increase the device's weight. The compartment may have a removable cover, and a plug may also be provided in the cover for filling the compartment with ballast such as sand or lead shot.

The device is supplied with a handle for easy manipulation by a user. The handle is removably attached at a first end to the rear portion, and the handle extends upwardly and rearwardly of the rear portion at an angle of inclination. Both the length of the handle and the angle of inclination of the handle are preferably adjustable by a user of the device. Handle bars may also be attached to the handle at its second end.

A carrying handle may be formed in the housing to assist in carrying the housing. If the rear wheels are provided with an axle, then this axle may conveniently form the carrying handle between the rear protrusions of the housing.

The device compresses the pile or tuft (nap) of the carpet and creates a seal with the carpet surface wide enough to focus the suction of the device to the flooded area directly below the rotor assembly. It is also intended that there be little or no appreciable compression of the pad or underlay underlying the carpet.

It is foreseen that the device will be connected to a high volume vacuum source in a remote location, typically a service truck, by means of a hose or other conduit. This conduit is connected to a specially designed flange that directs the vacuum flow directly into the rotor assembly contained within the cavity in the housing.

The rotor assembly has a number of passages through it that provide a path for the flow of the vacuum applied, and it is designed to project slightly proud of the flat surface on the underside of the device. The amount of projection of the rotor assembly is easily adjusted and helps the device move over a carpeted surface, and allows the device to move uninterrupted from carpet to a hard smooth surface. The projection of the rotor assembly is preferably large enough to permit the device to maintain an effective rolling action across a carpet or similar soft surface, while remaining small enough to permit the device to effectively remove water from a hard surface.

The friction generated between the surface being extracted and the rotor assembly is responsible for the rotation of the rotor. In addition, the opening on the underside of the device is designed to resist "jamming" by foreign objects, or the tufts of a carpet such as a large loop berber.

In a preferred embodiment of the invention, the entire handle assembly is easily removable from the housing portion of the device, and once removed exposes the wheel axle, that then becomes the carrying handle. This provides the operator with readily portable components for transportation to and from the job site, or up and down stairs. Separation of the handle arm assembly also makes the device reasonably compact, requiring little space for storage in a service vehicle.

The proposed device requires no lubrication and is proposed to be made from non-marking, non-corroding, durable materials of sufficient strength and thickness so as to resist damage from shock, or impact. The device requires no electricity, and functions in both forward and backward directions.

BRIEF DESCRIPTION OF DRAWINGS

In the accompanying drawings which illustrate various specific embodiments of the invention, but which should not be construed as restricting the spirit or scope of the invention in any way.

DESCRIPTION

Figure 1:
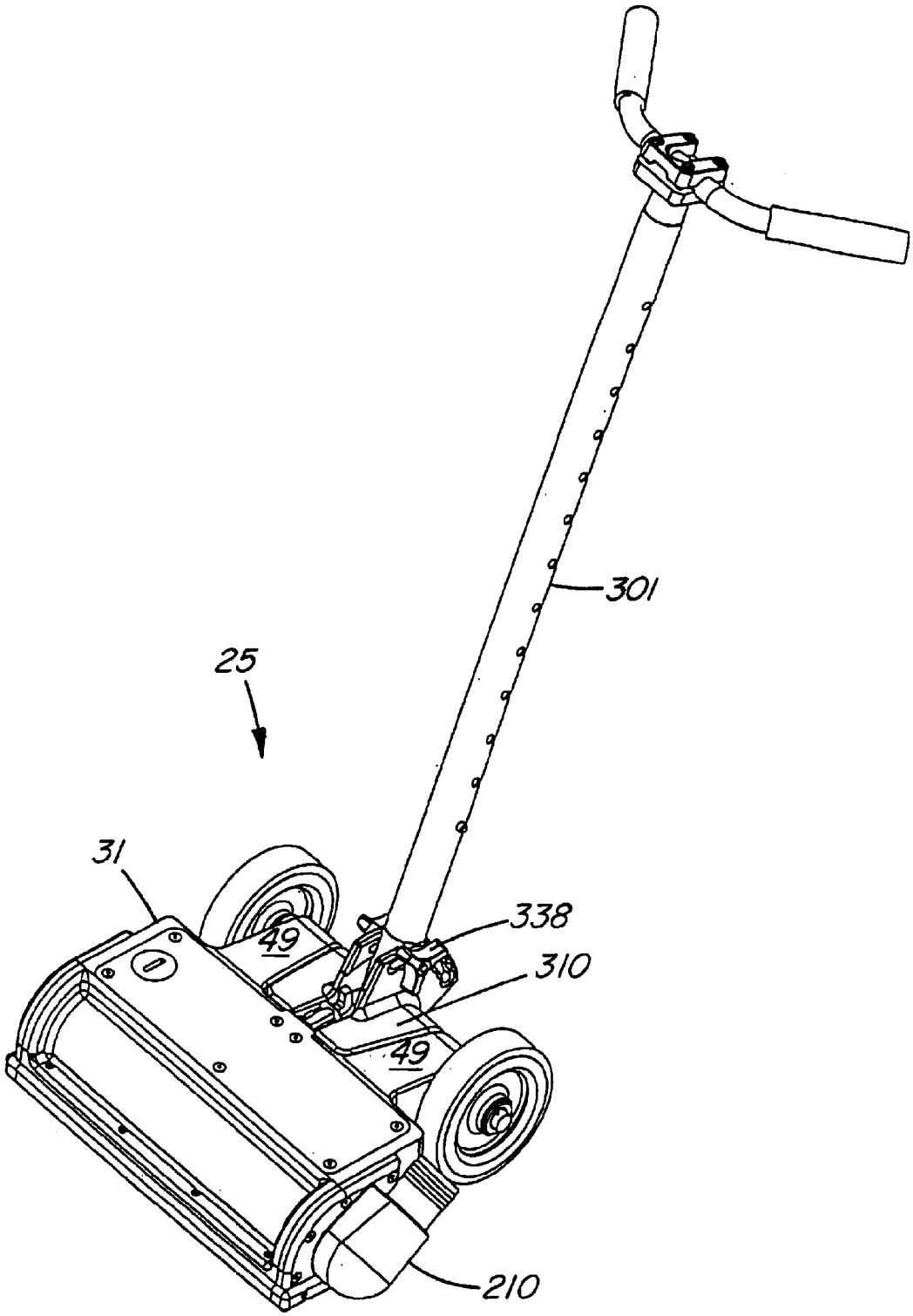
FIG. 1 is an isometric view of one embodiment of the water extraction device of the present invention.

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

For the purpose of describing and understanding the principles of the invention, reference will now be made to the embodiment illustrated in the drawings provided herewith and specific descriptive terms will be used for describing and summarizing the invention. It must be understood that language used is not intended to limit the scope of the invention. Any alterations, modifications, or the expansion of applications and principles of the invention as illustrated are herein envisioned as would normally occur to one competent in the vocation to which this invention relates.

The drawings illustrate a currently-preferred embodiment of the invention. Referring to the drawings, the invention provides a device, denoted general hereafter by the numeral "25", for extracting water from a carpet or other floor surface.

As shown in FIG. 1, the device 25 of the present invention is equipped to be connected to a vacuum source that provides the required flow of air to operate the device. The discharge end of this connection (not shown) is usually to a truck-mounted vacuum or suction pump via a conduit (again, not shown, and well known in the art), which is typically a reinforced plastic hose capable of withstanding the force of vacuum within it, with an inside diameter of 1.5 to 2 inches. The vacuum source is typically a high volume pump capable of approximately 125 cubic feet per minute. It will be appreciated that while portable vacuum sources may be used with this device, the sources used should preferably be capable of generating 180 inches of water lift in order to be able to extract the water from a carpet and accompanying underlay or pad. These portable vacuum or suction sources should also be equipped with a pump-out system in order to handle the large quantities of water being extracted. It is also preferable that shorter conduits or hoses be used in combination with portable vacuum sources. The vacuum source does not form part of the invention.

Referring to FIG. 1, in a preferred embodiment the device 25 is a modular design that has a housing 31, preferably made from a durable, corrosion-resistant material such as aluminium. In the currently-preferred embodiment the housing is cast as a single part, to which the other elements of the device are attached. Housing 31 generally has a front portion, a rear portion, a top portion, a bottom portion and first and second side portions.

Referring to FIGS. 8A–9D and 13, the forward portion of housing 31 houses a cavity 34 which has a rounded, generally cylindrical shape. Cavity 34 generally spans the width of housing 31. Located along the lower portions of cavity 34 are mounting surfaces 35 to which components are attached to form the lower portion of the cavity, as described in detail below.

Figure 3:
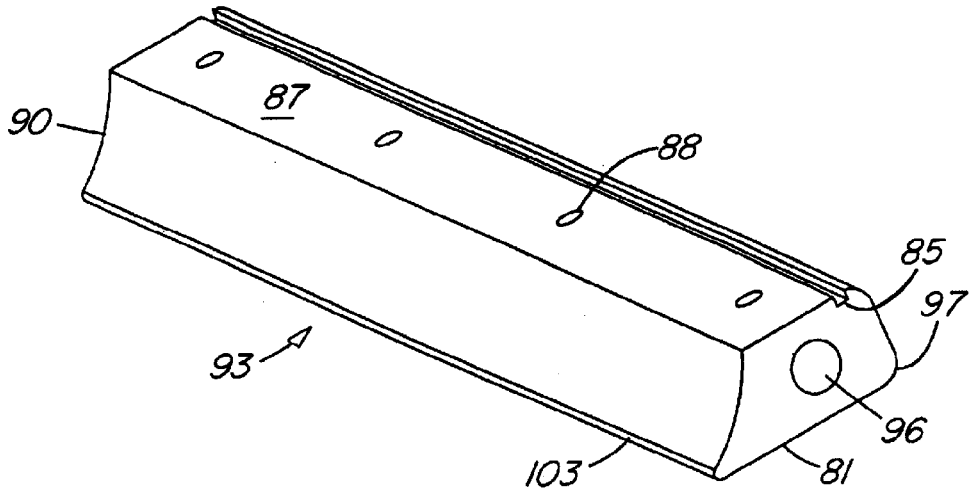
FIG. 3 is an isometric view of the forward bottom surface base member of the device shown in FIG. 1.

The lower portion of the cavity is comprised of two bottom surface base members 93, the front one of which is shown in FIG. 3. The rear one may be similar in appearance. Base members 93 provide a large flat surface 81 on the underside of the device. Both base members are approximately one (1) inch in thickness in one embodiment, and are fastened to the mounting surfaces 35 along the sides of the housing cavity 34 as illustrated. A radius 90 along the inside surface of the base members completes the modified cylindrical shape that is the interior of the cavity. In other words, the lower portions of each one of base members 93 have a downwardly-facing flat surface, and the upper portions of each one of base members 93 have an upwardly facing curved face, the respective curved faces defining the lower portions of the cylindrical cavity 34 in the housing.

The lower portion of cavity 34 defines a downwardly facing opening 74 (FIG. 10B) in the bottom portion, the opening 74 extending laterally across the bottom portion from the first side portion to the second side portion.

Figures 8A, 8B:
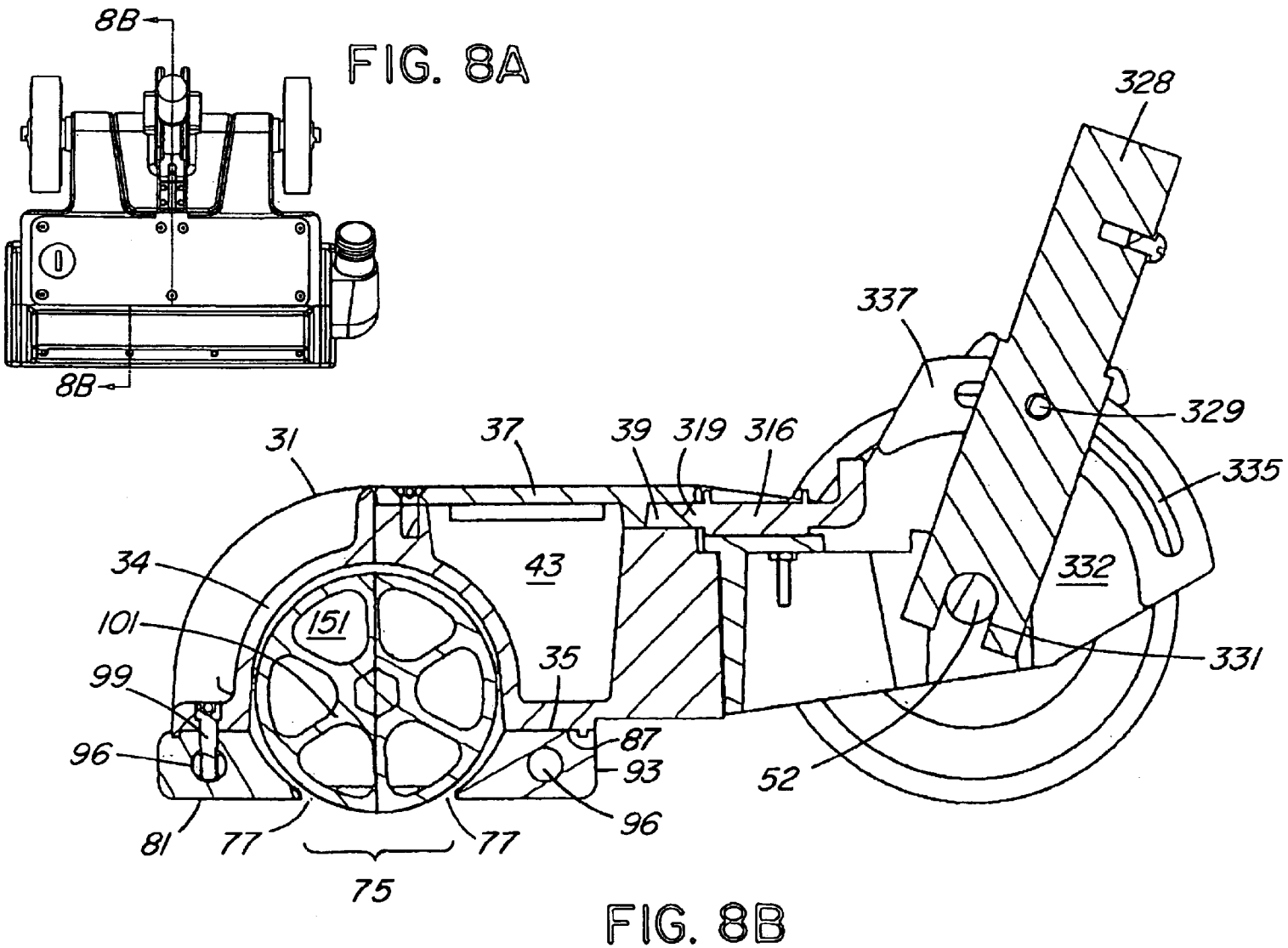
FIG. 8A is a top view of a portion of the device of the present invention.
FIG. 8B is a cross-sectional view of the device shown in FIG. 8A, taken along line 8B—8B of FIG. 8A.

Cavity 34 contains a rotor assembly 101 as shown in FIG. 8B. The rotor assembly contained within cavity 34 extends along the length thereof, with a portion of rotor assembly 101 protruding downwardly through opening 74, the rotor assembly 101 rotatable about its longitudinal axis relative cavity 34.

Each base member 93 of the device of the illustrated embodiment may be fastened by cap screws 99 (shown in FIG. 8B) that pass through the topside of the front and rear mounting surfaces on the housing and into a stainless rod 96 that has holes threaded at right angles to the rod's longitudinal axis, although this attachment could be achieved in any number of ways. Referring further to FIG. 3, each base member has one stainless rod 96 located within the centre of the member, spanning its length, and through the mating surface 87, holes 88 (FIG. 8B) are drilled therein that line up to the threaded holes of the stainless rod. This arrangement resists point loading and warping of the base members 93.

Referring again to FIG. 8B, each mounting surface 35 has a square tongue machined into it, and each mating surface 87 has a corresponding square groove 85 (FIG. 3) of similar size, spanning the width of the housing. This arrangement ensures the proper location of the upper and lower parts of the cavity and establishes the width 75 of the downward facing opening 74 as show in FIG. 10B. This arrangement also provides sufficient surface area to ensure a tight seal between mounting and mating surfaces of the housing and base members 93 respectively, as shown in FIG. 8B.

An alternate method of mounting the base members 93 to the housing is to provide contours that would allow the members to be "snapped" or "slid" into position. Possible such arrangements could be provided by machining dovetails to provide means for sliding the base members into place. Quarter turn fasteners could also be incorporated into the assembly to retain the members. The downward facing opening 74 and interior shape of the cavity is an important design element of the housing whether the part is cast or fabricated.

Figures 2A, 2B, 2C:
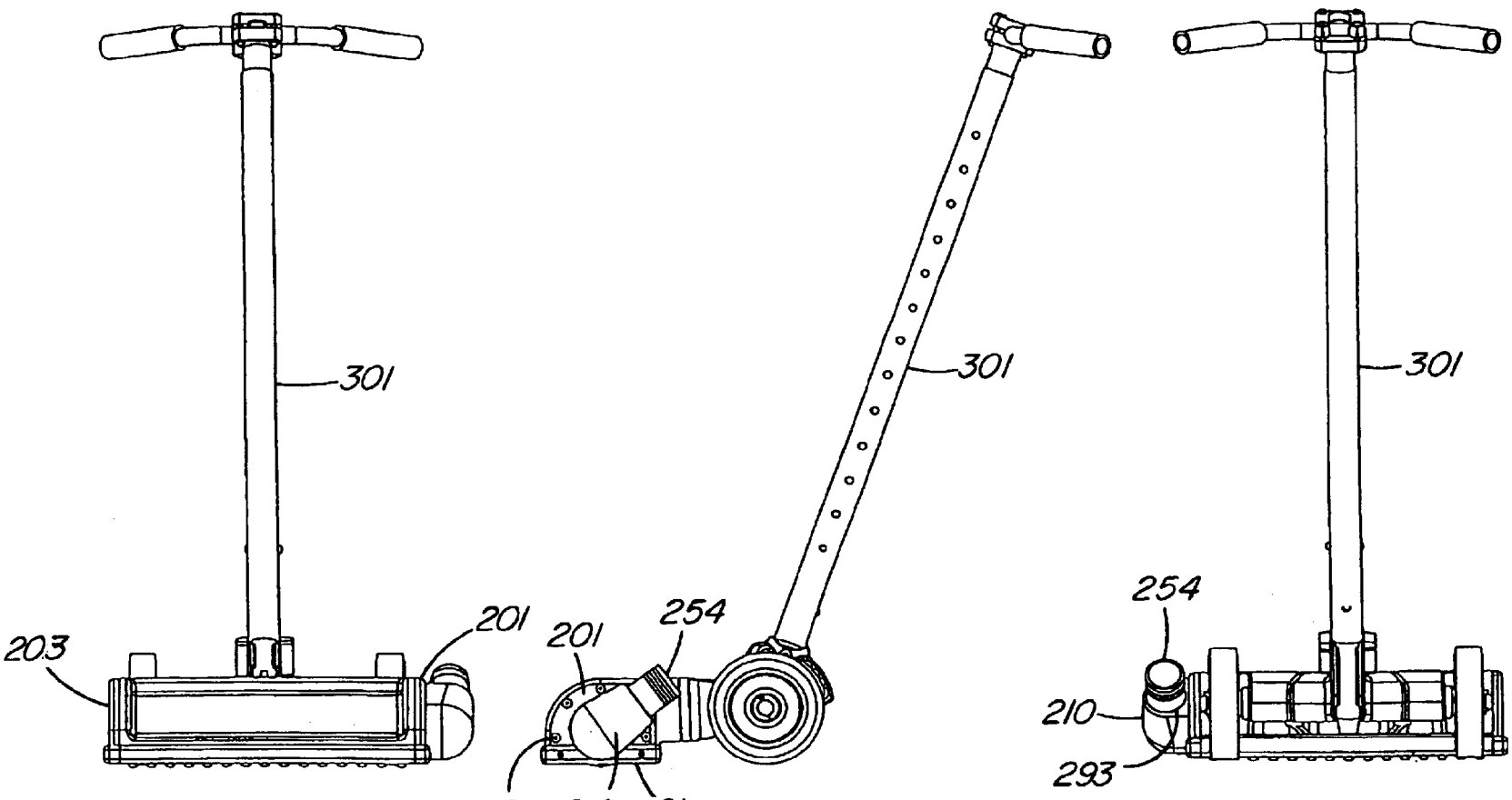
FIG. 2A is a front view of the device shown in FIG. 1.
FIG. 2B is a side view of the device shown in FIG. 1.
FIG. 2C is a rear view of the device shown in FIG. 1.
Figure 10A:
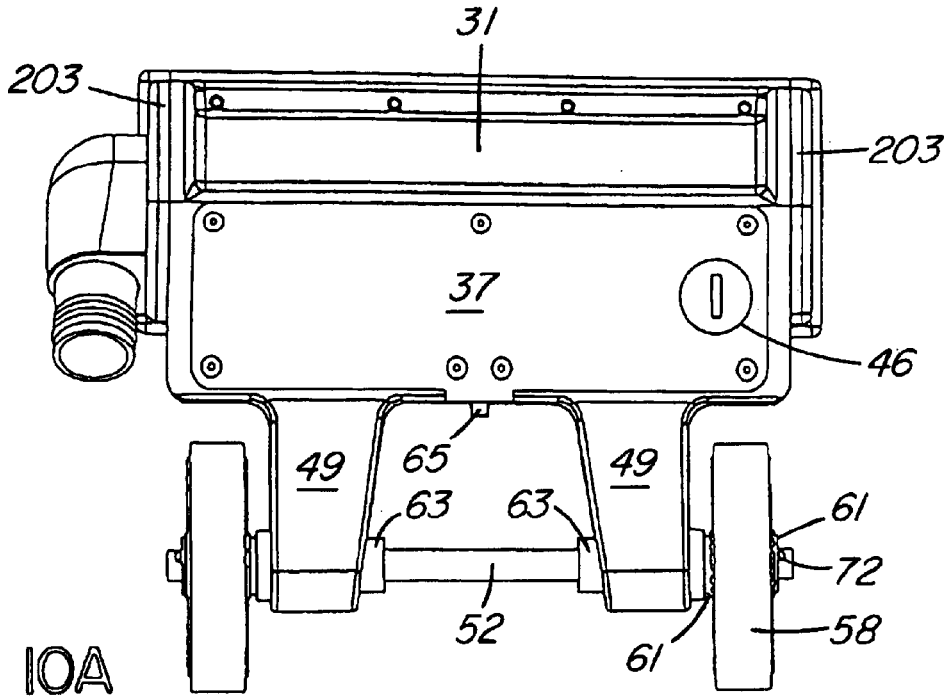
FIG. 10A is a top view of the housing of the device of the preferred embodiment of the invention.
Figure 10B:
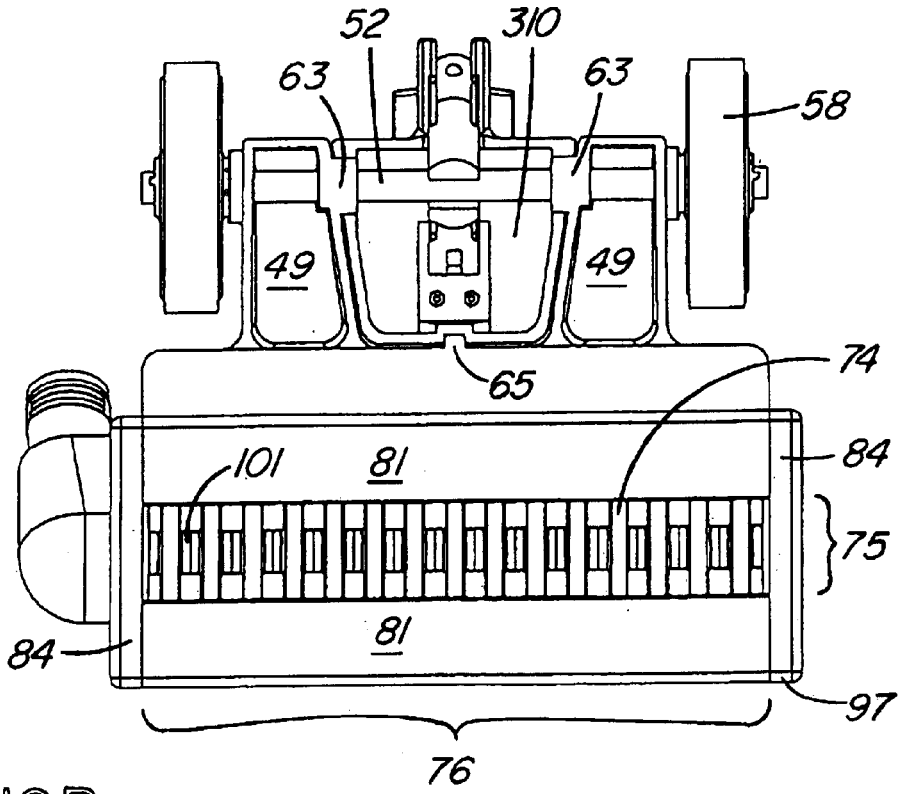
FIG. 10B is a bottom view of the housing of the device of the preferred embodiment of the invention.
Figure 11:
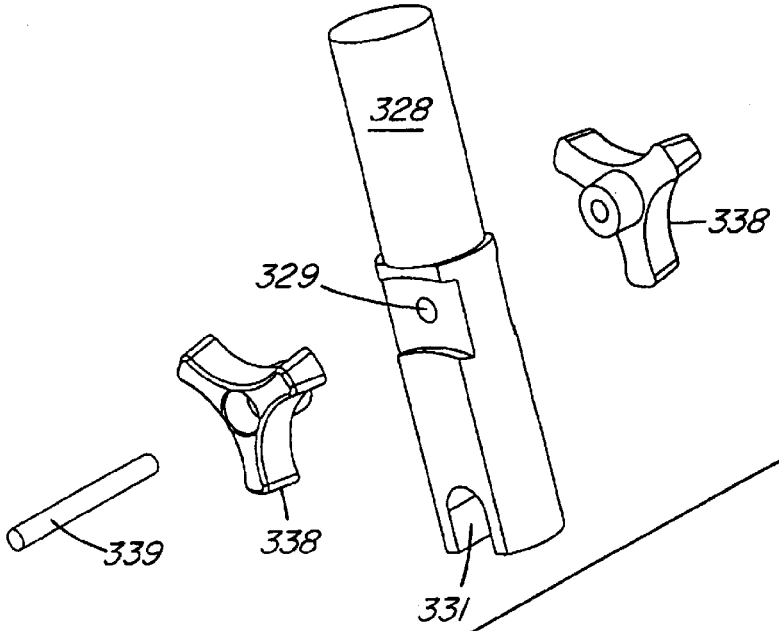
FIG. 11 is an exploded view of the handle arm pivot and adjustment knobs of the present invention.

Referring to FIGS. 2B and 10B, the large flat surface 81 on the underside of the device provides the important function of isolating and focusing the suction from within the rotor assembly 101 (FIG. 4B) directly to the flooded surface beneath the downward facing opening. The flat surface 81 on the underside of the device, is wide enough to compact an area of the tuft, pile or nap of the carpet, around the opening 74 such that the two surfaces act as seals, one to the other. This arrangement also reduces the weight requirements of the device, and effectively eliminates the stresses that would otherwise be exerted by a heavy rotor assembly on the backing of a carpet during the liquid extraction process.

The flat surface on the underside of the device also acts as a float, and since it has a smooth finish it allows the device to slide in both directions over a surface such as a carpet, while remaining in constant contact. This is to reduce the effort required from the operator.

Referring to FIGS. 3 and 10B, the current embodiment has a radius 97 of approximately 0.25 inches surrounding the outer edges of the base members 93 to reduce friction between the device and a carpeted surface. It may be desired to incorporate small diameter wheels, or rollers recessed in to the bottom of the front base member to help counteract the adhering forces created by the applied suction applied, or another arrangement may facilitate improved movement back and forth across a carpet.

It is preferable that the base members 93 are made from a material that is durable, non-marking, smooth, water resistant and with a low coefficient of friction, such as Acetal Homopoly (Delrin™), PTFE, polyethylene, or other material that provides similar qualities or properties.

Referring to FIG. 10B, the ratio of total flat surface 81 area on the underside of the device to the area of downward facing opening size should not be less than 1:1 when a rotor diameter of 6 inches or less is used. The current embodiment makes use of a ratio of approximately 2:1, and downward facing opening 74 through which the rotor assembly projects is approximately 30 square inches as shown in FIG. 8B.

Figure 4A:
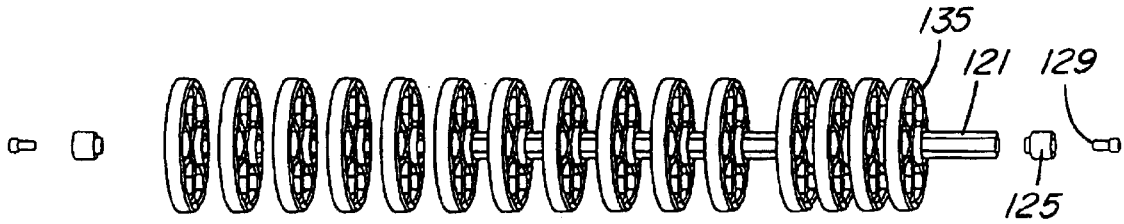
FIG. 4A is an exploded view of a rotor assembly made in accordance with one embodiment if the present invention.
Figure 4B:
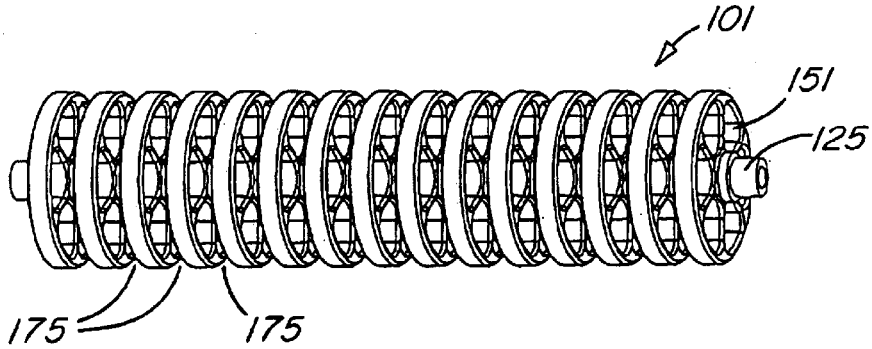
FIG. 4B is an isometric view of the rotor assembly shown in FIG. 4A, as assembled.
Figure 9A:
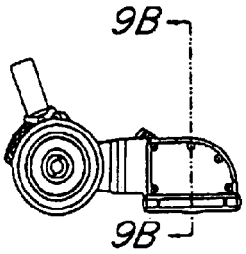
FIG. 9A is a side view of a portion of the device of the present invention.
Figure 9B:
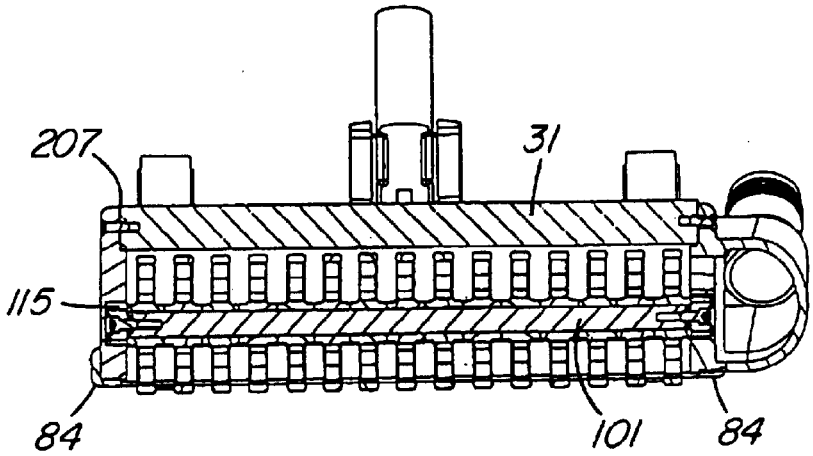
FIG. 9B is a cross-sectional view of the device shown in FIG. 9A, taken along line 9B—9B of FIG. 9A, with the rotor of FIG. 4B shown occupying the cavity of the device.
Figure 9C:
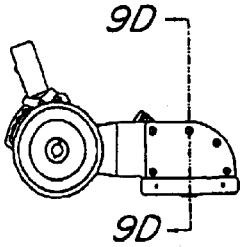
FIG. 9C is a further side view of a portion of the device of the present invention.
Figure 9D:
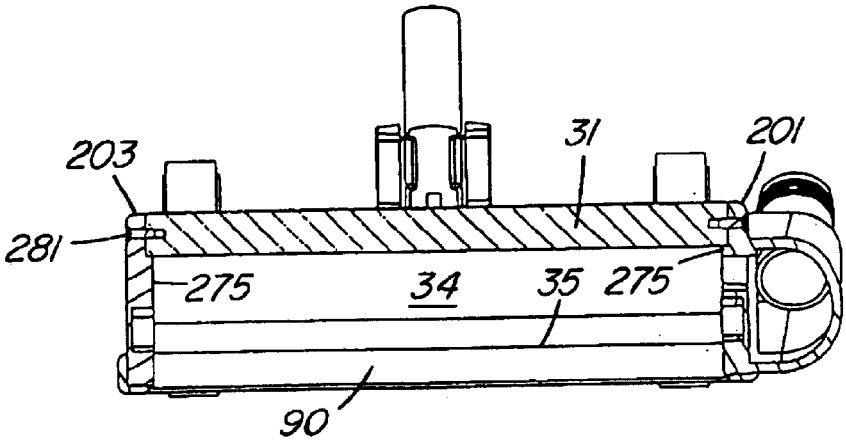
FIG. 9D is a cross-sectional view of the device shown in FIG. 9A, taken along line 9D—9D of FIG. 9C, without the rotor occupying the cavity of the device.

The rotor assembly 101 in the current embodiment is shown in FIGS. 4B and 9B. The rotor assembly is cylindrical in overall shape and may have a diameter of between 2 inches and 6 inches, as can be accommodated by cavity 34. The length of the rotor assembly is approximately equal to the width of the housing 31, and rotor assembly 101 has several interior passages 151 roughly parallel to the axis of rotation spanning its length. The current desired ratio between the diameter of the rotor assembly and the width 75 of the downward facing opening 74 is approximately 1.5:1 and is preferably kept above 1:1.

Referring to FIGS. 4A and 4B, the rotor assembly of the current embodiment is comprised of a rotor shaft 121 on which a plurality of spoked wheels 135 are mounted. A stub shaft 125 fastened at each end of the rotor shaft 121 secures the assembly and provides the ends of the axis about which the rotor assembly revolves.

The rotor shaft 121 of the current embodiment does not permit any of the spoked wheels 135 to spin freely. The preferred arrangement uses material with a hexagonal cross section. Alternatives to the current arrangement are various spline shaft configurations that would perform the same function, or a design may be incorporated which would allow each spoked wheel to be individually fastened to the rotor shaft. However, it may be preferable to let the spoked wheels spin freely on the rotor shaft in other embodiments.

The rotor shaft 121 in the current embodiment is preferably made from stainless steel or a material with similar properties, and may have a diameter of approximately 0.625 inches. The rotor shaft of the current embodiment also has a threaded hole at the bottom of a female socket machined into each end to provide means of fastening and locating the stub shafts 125. As shown in FIG. 8B, it may be preferable to use a material of smaller diameter for the rotor shaft to increase the size of the interior passages 151 of the rotor assembly.

The stub shafts 125 of the current embodiment are made from stainless steel having smooth bearing surface, and a diameter larger than the rotor shaft to prevent the spoked wheels from sliding off the rotor shaft 121. Currently, each stub shaft is fastened to the rotor shaft by a single cap screw 129 that passes through the axis of the part as shown in FIG. 4A. Alternatively, it may be preferable that the stub shafts take the form of a threaded cap that screws onto a male thread on the rotor shaft. It may also be preferable to eliminate the stub shaft by having the bearing surface machined directly on the rotor shaft at each end.

Referring to FIG. 4A, the stub shafts 125 in the currently-preferred embodiment are removable and allow the number of spoked wheels 135 to be changed or reconfigured along the rotor shaft.

Figure 5A:
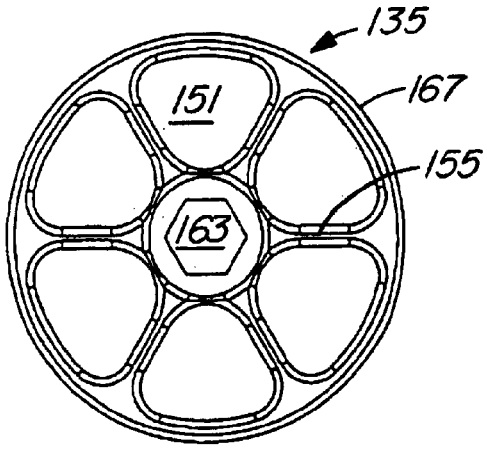
FIG. 5A is a plan view of a spoked wheel used in the rotor assembly shown in FIG. 4B.
Figure 5B:
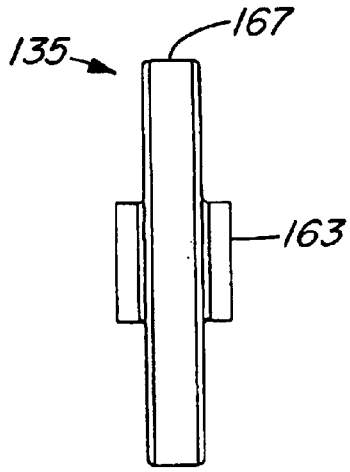
FIG. 5B is a side view of the spoked wheel shown in FIG. 5A.

A main component of the rotor assembly is the spoked wheel 135 as show in FIGS. 5A and 5B. Each spoked wheel in the current embodiment has six spokes 155 that radiate outwardly from a central hub 163 to the inside circumference of the rim 167. The opening between each spoke provides the interior passages 151 of the rotor assembly. The alignment of the spokes create the interior passages, and provide sufficient area for the flow of air, water and dirt through the rotor assembly and out of the housing 31.

In the current embodiment, the hub 163 of each spoked wheel is configured to suit the rotor shaft, and is wider than the rim 167. This arrangement provides a gap 175 between adjacent spoked wheels as shown in FIG. 4B, and creates a plurality of unobstructed paths into the interior passages 151 of the rotor assembly. In addition the current configuration allows the hub of each extraction wheel to be fitted tightly against one another along the rotor shaft when the rotor assembly is completed 101.

In the current embodiment a gap 175 of approximately 0.5 inches exists between the rim of each spoked wheel of a completed rotor assembly 101. This dimension can be altered by the operator changing the number of spoked wheels 135 along the rotor shaft. It is preferable to employ more than three wheels, and when a spoked wheel is removed a spacer may be inserted in its place. This spacer has an inside diameter large enough to fit over the rotor shaft, and is made from material that will not corrode.

The primary function of the rotor assembly is to ensure that the surface being extracted (the work piece) is not sucked up into the cavity 34, and to aid in the movement of the device. The ability to alter the gap 175 between adjacent spoked wheels 135 provides the user with the option of changing the size of the downward facing opening 74, and the surface area of the rotor that comes into contact with the floor. Thereby the rotor assembly may be appropriately adapted to the surface encountered, and allowance made for debris, dirt or sand. This is an important consideration when a glued down carpet or hard surface is encountered, and there is little risk of the carpet being sucked into the device or the carpet is in need of replacement after extraction.

When compared to a perforated cylinder or roller, the current rotor assembly is capable of readily adjusting its relative perforation density between 50 percent and 85 percent, plus or minus 5 percent, while retaining strength around the outer circumference. This is an improvement over prior art perforated cylinders which are not adjustable.

Figure 5C:
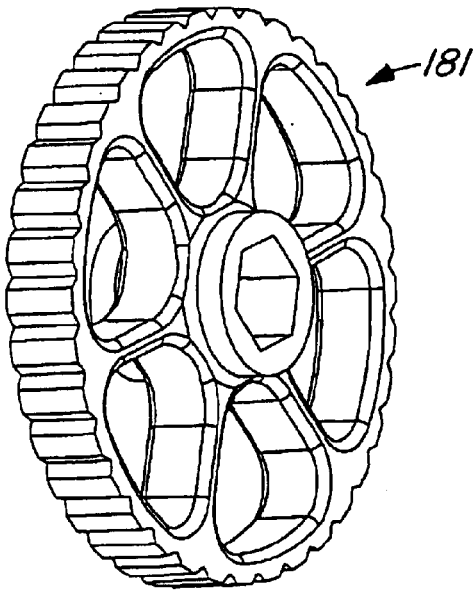
FIG. 5C is an isometric view of a spoked wheel of an alternative embodiment of the invention.
Figure 5D:
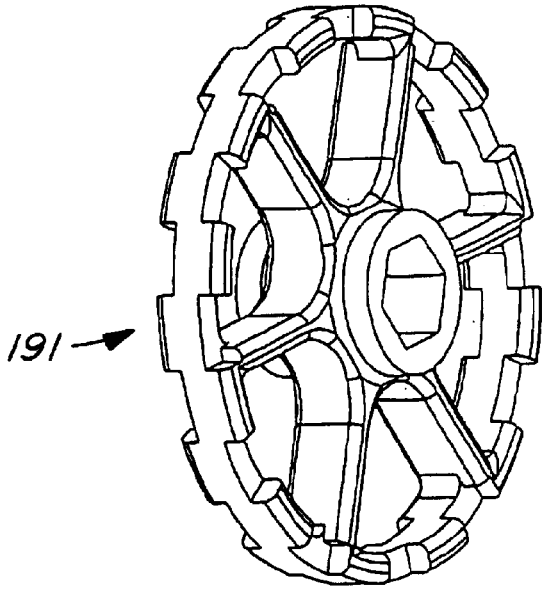
FIG. 5D is an isometric view of a spoked wheel of another alternative embodiment of the invention.

Referring to FIGS. 5C and 5D, it may by preferable to alter the texture or pattern of the rim edges on each spoked wheel as illustrated. Shown in FIG. 5C is a variation of rim texture, called herein the "v-groove" 181, which is intended to improve the traction of the rotor assembly. Other such variations of texture would include dimpling or pimpling the outer surface of the circumference. Shown in FIG. 5D is a variation of rim pattern, called herein the "alternating square notch" 191, intended to disperse the path of suction over a larger area beneath the rotor assembly. A "zig-zag" or other similar pattern could also be applied.

The width of the rim 167 is somewhat important, although not essential, when determining the strength of each extraction wheel, and its ability to effectively support the device, and to provide means to roll across a carpet or hard flooring surface, without damaging that surface.

The current embodiment of the spoked wheel 135 is preferably made from materials that provide minimal risk of damage a to a floor covering, and, are tough, non marking, resistant of impact, heat, chemicals and attack from micro-organisms, and which display excellent hydrostatic stability and molecular memory. One such material is polyurethane. It is also preferable that the spoked wheels be injection moulded for maintaining consistence of the rim and hub dimensions.

Referring to FIG. 8B, the distance between the inside surface of the cavity 34 and the outer surfaces of rotor assembly 101 is preferably kept at a distance that maintains a consistent clearance of no less than 0.03 inches. This arrangement provides adequate clearance for the rotor assembly 101, to freely revolve about its axis at or near the centre of the cavity, and to maintain the flow of air along the interior passages of the rotor assembly 151.

Referring to FIG. 3, in the currently-preferred embodiment the radius 90 fashioned into the inside surface of the base member 93 is slightly larger than that of the upper portion of the cavity 34. This provides additional clearance for the rotor assembly to deflect and deform in the event of a sharp impact.

Referring to FIG. 8B, the gaps 77 between the front and rear edges of the downward facing opening 74, and outer circumference of the rotor assembly 101, is preferably wide enough to resist "jamming" by foreign objects and by the tufts, pile or nap of a carpet, such as a large looped berber. Ideally, the size of this gap will be the same as the distance between the inside surface of the cavity and the rotor assembly. In addition it may be preferable to incorporate a small radius, or bevel, along the front and back edges 103 of downward facing opening as shown in FIG. 3 to reduce the risk of "jamming" of the rotor assembly by a foreign object.

Referring to FIGS. 8B and 9B the rotor assembly protrudes through the downward facing opening. Therefore, the assembly 101 is slightly proud of the plane established by the flat surface 81 on the underside of the device.

Figure 6:
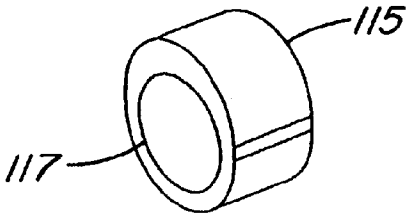
FIG. 6 is an isometric view of the eccentric bearing of one embodiment of the invention.

Referring to FIG. 4B, the stub shafts 125 are supported within rotor bearings 115, as shown in FIG. 6, located in each side portion of the device. In the current embodiment, the sides are comprised of flanges that are fastened to each side of the housing 31, forming the ends of cavity 34 of the housing 31.

Figure 7:
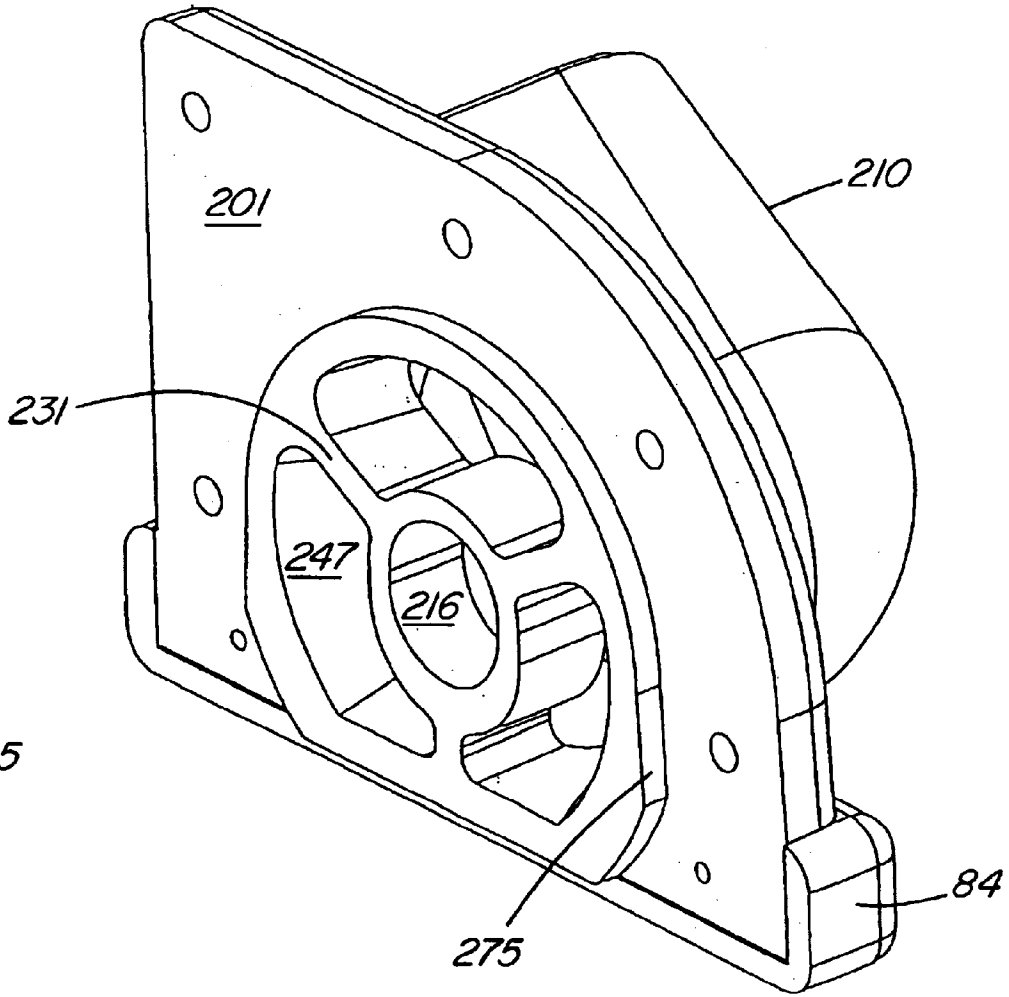
FIG. 7 is an isometric view of a side portion of the housing of the device of the preferred embodiment, showing the passageways formed through the side portion and an elbow attached to the exterior of the side portion.

The rotor bearings 115 of the currently preferred embodiment are oval externally and the interior surface in which the stub shaft revolves 117 is offset from centre as shown in FIG. 6. In other words, they might be said to be asymmetric or eccentric. Referring to FIG. 8B, the operator is provided with a means to alter the amount of protrusion of the rotor assembly with respect to the flat surface 81 on the underside of the device. The current arrangement requires the operator to remove the rotor bearing from its recessed receptacle 216 as shown in FIG. 7, rotate the bearing 180 degrees, and then reinsert it.

The current design allows the amount of protrusion of the rotor assembly as shown in FIG. 8B to be altered from approximately 0.20 to 0.10 inches. These dimensions allow the devices to roll across a carpet (a soft surface), while permitting this tool to remove water from a hard surface. It may be preferable to provide a second set of rotor bearings that would permit the rotor assembly to protrude up to 0.25 inches to deal with an extremely plush or soft surface.

Referring to FIG. 6, the rotor bearings 115 preferably require no lubrication, and are made from a material with similar properties as those which comprise the base members. The rotor bearings are preferably flanged, drafted or supplied with other means for the operator to remove easily. Ideally the projection of the rotor assembly may be mechanically altered without the need to physically handle the rotor bearing.

In the preferred embodiment a cover flange 203 is provided on one side of the device, and a discharge flange 201 is provided on the opposite side, as shown in FIGS. 2A and 10A. It may be preferable to reverse this arrangement, or to have a discharge flange on each side of the device.

Referring to FIGS. 2B and 9B, the discharge flange 201 provides the device with a means to attach the device to the suction conduit of the remote vacuum source, and this forms the passage of flow from the rotor assembly into the suction conduit. There is no flow through the cover flange 203 and the design is intended to get the side of the device and downward facing opening to within 1.0 inch of a wall.

Both flanges in the current embodiment have a recessed bearing receptacle 216 machined into the inside face of each flange. Referring to FIG. 7, the discharge flange 201 has the recessed bearing receptacle supported by rigid vanes 231 or spokes at or near the centre of hollow discharge passages 247 that continue through to the discharge elbow 210. Ideally there is only a single discharge passage 247 to provide maximum flow through the device. This could be accomplished by using a single vane to support the bearing receptacle.

Preferably, the inside faces of both flanges 201, 203, as illustrated by FIG. 7, have a shoulder 275, the geometry of which resembles the cross-sectional profile of the cavity as shown in FIG. 8B. Each shoulder fits into the cavity on each side of the device, aligning both flanges, and keeps the axis of revolution of the rotor assembly 101 more true as shown in FIG. 9B. The location of the recessed bearing receptacle is determined from the centre of the radius that fits into the cavity of the housing.

Figure 13:
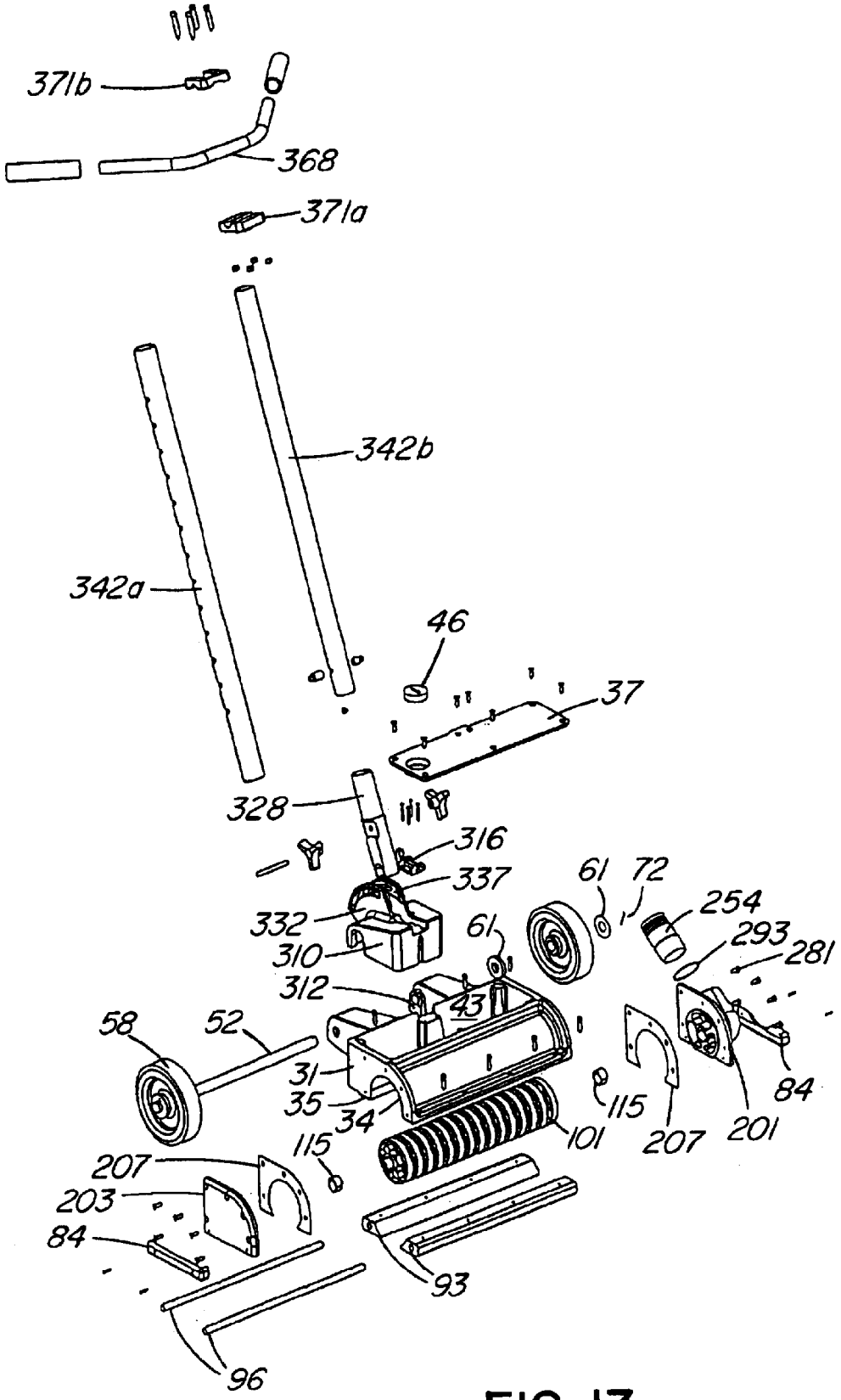
FIG. 13 is an exploded view of the device of the preferred embodiment of the present invention.

Both flanges in the current embodiment are fastened to a respective side of the housing 31 by five stainless steel machine screws 281, countersunk into the flanges as illustrated by FIGS. 2B, 9B and 13. The fasteners are threaded into the to the structural mounting points provided on each side of the housing 31. A flange gasket 207 is located between the housing and each flange to ensure a vacuum tight seal of the cavity. In addition, both flanges provide a sufficient material thickness to hold the bearings within them, and provide mounting points for the side base components 84 that complete the flat surface on the underside of the device as shown in FIGS. 7, 9A and 10A.

Fitted onto the bottom of each flange in the current embodiment, are the side base components 84 that define the overall length 76 of the downward facing opening and total area of the flat surface 81 on the underside of the device as shown in FIG. 10B. The current configuration is such that each side base component 84 is fastened to each side flange by two stainless steel screws. It may be preferable to have the side base components provide a flat surface 81 as wide as that of the front and rear base members 93.

Referring to FIGS. 1 and 13, the discharge flange 201 has an elbow 210 of roughly 90 degrees mounted on the outer face that provides the passage of flow from the rotor assembly to the suction conduit. Providing the connection between the elbow 210 and suction conduit is a male hose connector 254 that is secured within the opening of the elbow. A rubber "o-ring" 293 is placed between the two parts to ensure a tight seal as illustrated in FIGS. 2B and 13.

Referring to FIG. 2B, the angle at which the discharge 254 of the male hose connector of the discharge elbow 210 is set on the side of the device is about 36 degrees. It may be preferable to rotatably affix the elbow, allowing it to rotate a full 180 degrees on the outside face of the discharge flange to provide a means for the suction conduit to approach from the front or rear of the device.

Referring to FIG. 8B, within the current embodiment the ratio of total cross section area of the interior passages 151 within the rotor assembly, the discharge passages 247 and discharge elbow 210 to the cross section area of a suction conduit with inside diameter of 2 inches is approximately 1:1. It may be preferable to alter this ratio in future embodiments by changing the interior passages 151 of the rotor assembly.

The current embodiment makes provision for applying additional weight. Referring to FIGS. 8B and 13, behind the forward cavity and into the top of the housing 31 in the current embodiment, is an upward facing compartment 43. A top cover plate 37 is fastened to structural mounting points (bosses) provided by the casting of the housing 31. This compartment provides a volume of approximately 115 cubic inches, sufficient for holding approximately 45 pounds of weight, and is equipped with plug 46 threaded into the top plate 37 for the operator to adjust the amount of weight contained within the compartment. It is preferable that the means of closing the aperture in the top plate does not "pop-out" from the force of the material behind it.

The weight compartment provides the operator with a means of adjusting the amount of weight applied to the flat surface on the underside of the device. It is important to note that the use of weight is optional, and is not always required, as when removing standing water from a hard surface. It may be preferable to provide the weight source as two separate containers that are held in place by the upward face compartment of the device.

The housing 31 as shown in FIG. 10 has two protrusions 49 projecting rearwardly for approximately 5 inches, approximately 5 inches apart. The rear protrusions preferably support and retain an axle 52 parallel to and slightly above the axis of revolution of the rotor assembly 101 as shown in FIG. 8B. The axle 52 is inserted through a hole in each protrusion and the exposed axle between the two protrusions may act as a handle for lifting or carrying the device. A wheel 58, currently six inches in diameter, is placed on the axle at each end, and spins freely. The wheels are held between washers 61 which in turn are held in place by a cotter pin 72, as shown in FIG. 13, or other like means that would provide similar fastening capabilities, and ease of removal. It is preferable that the wheels do not extend beyond the width of the device, providing the ability to extract water from a carpet edge that is adjacent to a wall.

The device 25 in its current embodiment is a manual tool and does not require electricity to be operated since it does not currently have a motor. Therefore the device is equipped with a handle assembly 301 shown in FIGS. 2A, 2B and 2C to provide the operator a means of pushing or pulling the device. It may be preferable to provide a means of propelling the device or incorporating a motor in future embodiments.

The handle assembly 301 is secured to the device 25 between the two protrusions 49 from the rear of the housing 31, as shown in FIG. 1. The handle assembly is attached to the device by the handle insert 310 having two notches 312 that fit snugly over small trunnions 63 protruding inwardly along the axle from the inner face of each rear protrusion 49. The insert 310 of the current embodiment also has a slot 313 that fits over a vertical track 65 on the rear of the housing that helps prevent any "slop" between the housing 31 and handle assembly 301 as illustrated in FIGS. 10A and 10B.

The entire handle assembly 301 as shown in FIG. 1 is easily removable from the assembled housing, and once removed exposes the wheel axle 52 (FIG. 10A) which then becomes a handle to carry the device when necessary. This provides the operator with readily portable components for transportation to and from the job site, or up and down stairs. Separation of the handle arm assembly also makes the device reasonably compact, requiring little space for storage in a service vehicle.

Figure 12:
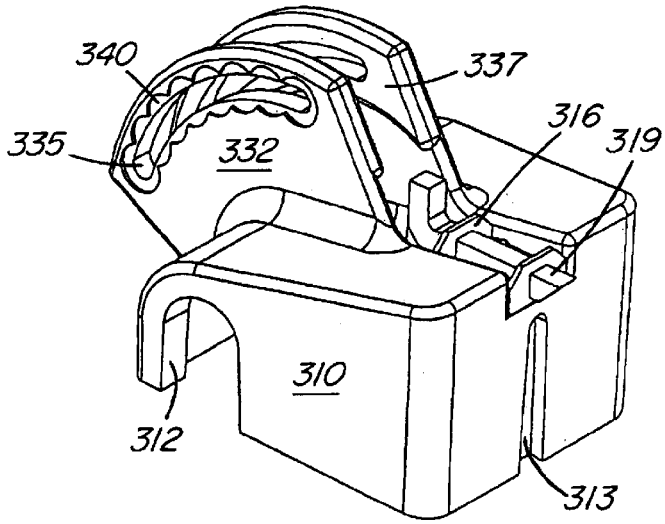
FIG. 12 is an isometric view of the handle adjustment assembly of the present invention, showing the insert and latch of the preferred embodiment.

In the current embodiment, the handle arm insert is held in place by latch 316 as shown in FIGS. 8B and 12 fastened to the top by four stainless screws or rivets. The latch has a retractable pin 319 that extends into a receptacle 39 located at the rear of the housing below the top plate 37, or other such arrangement that would hold the handle arm insert firmly in position.

The current arrangement of the handle insert 310, as shown in FIGS. 8B and 12 has two vertical adjustment tangs 332, and a slot 335 through each tang. The arm pivot 328 is the connection between the handle insert and the rest of the handle assembly. The arm pivot is slid between the tangs 332 along tracks 337, and a hole 329 through the arm pivot is aligned with the slot 335 through the tangs. The arm pivot 328 is held in place by a threaded stud 339 through the slots 335 in each tang and the hole 329 in the arm pivot, and a knob 338 at each end of the threaded stud tightens down against the outside of the tang 332. It is preferable that the surface to which the knob is tightened against has small recesses 340 to prevent the handle arm from slipping or moving once a position is set. The arm pivot also has a notch 331 at the lower end that is fit over the axle 52 helping to secure the insert into position and provide a fulcrum of mechanical advantage.

The current embodiment allows for a full range of handle positions and therefore the angle of mechanical advantage may be altered. It is preferable that the range of angle of mechanical advantage, of the handle arm, span a full 90 degrees, from the vertical position to the horizontal position, thus allowing the device to readily travel beneath obstructions, and reduce the physical effort required from the operator. It is preferable that arm pivot provides the operator an assembly such as a universal joint or ball joint to steer the device while not diminishing performance.

Referring to FIG. 13 of the current embodiment of the device, the handle arm 342 is fit over the upper end of the arm pivot 328 and is held in place by a screw or some other fastening device which would provide a similar function. The handle arm 342 is comprised of two tubes that are telescoping. The current arrangement is such that the outer handle arm tube 342*a* has a outside diameter of approximately 1.5 to 2 inches, and the inner arm tube 342*b* is slid inside providing the telescoping arrangement. Both of the handle arm tubes 342*a*, 342*b* are approximately 40 inches in length, and the outer arm tube 342*a* has holes drilled through the centre at intervals of 2 inches along its length. The inner arm tube 342*b* has a hole drilled through the centre approximately 2 inches from one end. Inserted, and fitted into the bottom of the inside tube, is a compressible spring pin 355 that expands through the holes drilled into the handle arm.

This mechanism allows for the adjustment of the length of the handle arm 342, from approximately 38 to 72 inches. The preferred embodiment is a mechanism that provides many adjustments to suit a operator of any height, making the device easier to use, and to reduce as much as possible physical stress on the operator.

Attached to the upper end of the handle arm assembly 301 are the handlebars 368 as seen in FIG. 2C. In the current embodiment the handle assembly has handlebars 368 preferably fashioned or angled in such a way as to relieve as much stress as possible from the shoulders, arms and wrists of the operator. The current configuration has the handlebars are attached to a handle arm 342 by a clamp 371, shown in FIG. 13 consisting of a lower clamp 371*a* and upper clamp 371*b* fastened to one another by nuts and bolts. Any similar arrangement can be employed. In the current embodiment the lower clamp 371*a* is welded to top of the handle arm assembly 301.

The handle arm assembly is intended to provide a means of pushing or pulling the device and offers a mechanical advantage that makes the device easier to use. The current design provides such a mechanism, and is intended to relieve as much stress as possible from the wrists, arms and back of the operator. However, the handle arm assembly may be altered or reconfigured into any number of designs that would essentially fulfil the same objectives as that of the current embodiment.

In operation, as the device glides across a flooded surface, usually carpet, a seal is created between the carpet and the flat surface on the underside of the device. Thereby the applied suction is isolated and focussed on the flooded surface directly below the rotor assembly and the friction generated between the surface being extracted and the rotor assembly is responsible for the rotor's revolution and for allowing the device to be moved. The device may be aided by a weight source although the device does not rely on any significant compression or "squeezing" of the carpet and pad by the rotor assembly to function properly. The current device is not intended to "wring-out" water for extraction by the use of excessive weight. Therefore, any weight added to the compartment provided is primarily for ballast, and to facilitate a tight seal between the pile, nap or tuft of the carpet and the flat surface on the underside of the device. This arrangement ensures that the primary or secondary backing and/or seams of a flooded carpet are not damaged by the device. This arrangement also reduces the physical stresses exerted on the operator.

With the present invention it is foreseen that the operator may extract water from any flooded flooring surface, from hard surfaces such as linoleum, concrete, or tile, to soft surfaces including various combinations of carpet and pad. The current device is only significantly limited in its functioning efficiency by the suction supplied by a remote source and, and skill of the operator.

The device requires no electricity, and functions in both forward and backward, directions. The tool is manually operated and is equipped with a handle that adjusts to any position, and this, therefore, creates a mechanical advantage that helps to reduce stress on the operator. In the absence of any motors, the operator does not need to operate the device at any predetermined speed, and extraction times are therefore dependent upon the nature of the surface being extracted, the amount of liquid (water) present, and the skill of the operator. Experimental results have shown that the extraction times of this device are essentially one-half that of other tools or methods currently in use.

The current embodiment is moderately light in weight, approximately 30 pounds (without ballast) and is equipped with a handle (axle) incorporated into the device between the rear wheels for ease of transport to and from the job site, or up and down stairs. The current embodiment of the device is reasonably compact for ease of storage in a service vehicle, having current dimensions of approximately 7 inches in height, 15 inches in length, and 20 inches wide. The low profile of the device, especially with the preferred incorporation of an inlet elbow that rotates, allows the device to pass beneath obstacles.

Once a carpet and pad or combination thereof has been extracted by this invention, it may be subjected to conventional cleaning techniques, and there may be no need for the replacement of the carpet, this results in substantial savings to the owner, or insurance company.

The invention of the current embodiment incorporates a modular design that makes allowance for preferred improvements. It is preferred to have the ability to apply cleaning solutions and disinfectants as part of a cleaning process. Therefore, one preferred embodiment is to have solution injection jets (not shown) installed as part of the base members, and connected to a hardware manifold installed within the rear compartment of the housing or similar arrangement. It is also foreseen that the device could also function as a floor dryer, by reversing the flow of air through the device with a warm or de-humidified air supply.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A device for extracting a liquid from a surface, said device comprising:

a) a housing having a front portion, a rear portion, a top portion, a bottom portion and first and second side portions;

b) a generally cylindrical cavity defined within the interior of said housing, the lower portion of said cavity defining a downwardly facing opening in said bottom portion, said opening extending laterally across said bottom portion from said first side portion to said second side portion, wherein said bottom portion comprises a flat bottom surface surrounding said opening;

c) a passageway defined between said cavity and the exterior of said housing, said passageway thereby allowing a fluid connection between said cavity and a vacuum source external to said device; and d) a rotor assembly contained within said cavity and extending along the length thereof, a portion of said rotor assembly protruding downwardly through said opening, said rotor assembly rotatable about its longitudinal axis relative said cavity wherein said rotor assembly has an interior fluid passageway.

2. The device of claim 1 wherein said bottom portion further comprises:

a) the lower portions of said side portions; and b) forward and rearward bottom surface base members, the lower portions of each one of said base members having a downwardly-facing flat surface, and the upper portions of each one of said base members having an upwardly facing curved face, said respective curved faces defining the lower portions of said cylindrical cavity in said housing.

3. The device of claim 2 wherein said lower portions of said side portions and said base members are constructed of a smooth, low-friction material.

4. The device of claim 3 wherein the ratio of the area of the bottom surface to the area of the opening is at least 1:1.

5. The device of claim 1 wherein said longitudinal axis of said rotor assembly is parallel to said bottom portion.

6. The device of claim 5 wherein said rotor assembly comprises a plurality of axially-spaced wheels removably mounted on a shalt rotatable in bearings mounted in said aide portions.

7. The device of claim 6 wherein said bearings are eccentric, thereby allowing adjustment of the vertical height of said axis of rotation of said rotor assembly and the vertical distance said rotor assembly protrudes from said opening.

8. The device of claim 6 wherein said rear portion further comprises:

a) first and second protrusions protruding rearwardly from said front portion; and b) a rear wheel attached to each one of said rear protrusions.

9. The device of claim 8 wherein said rear wheels do not extend laterally beyond the outer edges of said side portions of said housing.

10. The device of claim 8 further comprising a handle for carrying said housing, said carrying handle formed between said rear protrusions.

11. The device of claim 10 wherein said carrying handle comprises an axle extending between said wheels.

12. The device of claim 6 wherein said top portion comprise a compartment formed therein for accepting ballast added to said device to increase said device's weight.

13. The device of claim 12 wherein said compartment has a removable cover.

14. The device of claim 13 wherein said cover has a removable plug.

15. The device of claim 6 further comprising a handle for manipulating said housing, said handle removably attached at a first end to said rear portion, and said handle extending upwardly and rearwardly of said rear portion at an angle of inclination.

16. The device of claim 15 wherein the length of said handle is adjustable by a user of said device, and wherein said angle of inclination of said handle is adjustable by a user of said device.

17. The device of claim 16 wherein handle bars are attached to a second end of said handle.

18. The device of claim 17 wherein said handle is attached at said rear potion to a handle adjustment assembly fitted between said rear protrusions.

19. The device of claim 6 wherein each one of said wheels comprises a hub, a rim, and a plurality of spokes extending between said hub and said rim, said spokes defining fluid passages through said wheel from one side thereof to the other.

20. The device of claim 19 wherein each wheel is axially-spaced from an adjacent wheel on said shaft such that said rims of said adjacent wheels are spaced from one another.

21. The device of claim 20 wherein the spacing between said rims is adjustable by altering the spacings between the wheels on said shaft.

22. The device of claim 21 wherein said rims of said wheels have ridges.

23. The device of claim 21 wherein the lateral edges of said rims of said wheels are not straight.

24. The device of claim 1 wherein said side portions are removable from said housing.

25. The device of claim 1 wherein said passageway is defined in a side portion, further comprising an elbow rotatably affixed to said side portion through which said passageway extends for permitting attachment of said device to a conduit attached to said vacuum source.

* * * * *